US009703235B2

(12) United States Patent
Suenami

(10) Patent No.: US 9,703,235 B2
(45) Date of Patent: Jul. 11, 2017

(54) DEVELOPING DEVICE AND IMAGE FORMING APPARATUS THEREWITH

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/167,520

(22) Filed: May 27, 2016

(65) Prior Publication Data

US 2016/0370734 A1 Dec. 22, 2016

(30) Foreign Application Priority Data

Jun. 19, 2015 (JP) ..... 2015-123983

(51) Int. Cl.
*G03G 15/08* (2006.01)

(52) U.S. Cl.
CPC ..... *G03G 15/0889* (2013.01); *G03G 15/0865* (2013.01)

(58) Field of Classification Search
CPC ..... G03G 15/0889; G03G 15/0812; G03G 15/0891; G03G 15/0893; G03G 2215/0822; G03G 15/0865
See application file for complete search history.

(56) References Cited

U.S. PATENT DOCUMENTS

2009/0214266 A1* 8/2009 Kato ..... G03G 15/0893 399/254
2009/0245879 A1* 10/2009 Minami ..... G03G 15/0822 399/255
2015/0003876 A1 1/2015 Iida et al. ..... 399/254
2015/0139697 A1* 5/2015 Tsukijima ..... G03G 15/0893 399/254
2015/0331360 A1* 11/2015 Akedo ..... G03G 15/0893 399/254

FOREIGN PATENT DOCUMENTS

JP 2015-11158 A 1/2015

* cited by examiner

*Primary Examiner* — Sandra Brase
(74) *Attorney, Agent, or Firm* — Stein IP, LLC

(57) ABSTRACT

A developing device includes a developer container, a first stirring member, a second stirring member, and a developer carrying member. The second stirring member includes a second transport blade for transporting developer inside a second transport chamber, a regulating portion formed next to, on the downstream side of, the second transport blade in the transport direction of the developer inside the second transport chamber and formed by a transport blade that transports developer in the opposite direction to the second transport blade, a discharge blade formed next to, on the downstream side of, the regulating portion in the transport direction of the developer and transporting developer in the same direction as the second transport blade to discharge the developer through the developer discharge port, a first disk formed between the second transport blade and the regulating portion, and a second disk formed between the regulating portion and the discharge blade.

4 Claims, 5 Drawing Sheets

--Related Art--

DEVELOPING DEVICE AND IMAGE FORMING APPARATUS THEREWITH

INCORPORATION BY REFERENCE

This application is based upon and claims the benefit of priority from the corresponding Japanese Patent Application No. 2015-123983 filed on Jun. 19, 2015, the entire contents of which are incorporated herein by reference.

BACKGROUND

The present disclosure relates to a developing device incorporated in an image forming apparatus exploiting electrophotography, such as a copier, a printer, a facsimile machine, a multifunction peripheral thereof, etc., and to an image forming apparatus incorporating such a developing device. More particularly, the present disclosure relates to a developing device which can be replenished with fresh two-component developer containing toner and carrier and can meanwhile discharge surplus developer, and to an image forming apparatus incorporating such a developing device.

In an image forming apparatus, a latent image formed on an image carrying member comprising a photosensitive member or the like is made visible by being developed into a toner image by a developing device. Some such developing devices adopt a two-component developing system that uses two-component developer. In this type of developing device, two-component developer (hereinafter, also referred to simply as developer) containing carrier and toner is stored in a developer container, there is arranged a developing roller which feeds the developer to the image carrying member, and there is arranged a stirring member which transports, while stirring, the developer inside the developer container to feed it to the developing roller.

In the developing device, toner is consumed in developing operation, while carrier is left unconsumed in the developing device. Thus, the carrier stirred together with toner inside the developer container deteriorates as it keeps being stirred repeatedly, gradually diminishing the toner charging performance of the carrier.

As a solution, developing devices have been proposed that supply fresh developer containing carrier into a developer container while discharging surplus developer so as to suppress degradation in charging performance.

For example, a known developing device based on a system in which fresh carrier and toner are supplied into a developer container includes a first transport portion which transports developer inside a developer container, a second transport portion which is arranged on the downstream side of the first transport portion with respect to the transport direction thereof and which is formed by a helical blade spiraling in the opposite direction so as to transport developer in the opposite direction to the first transport portion, a disk portion arranged on the upstream side of the second transport portion with respect to the transport direction thereof, and a third transport portion which is arranged on the upstream side of the disk portion with respect to the transport direction of the second transport portion, for transporting developer into a developer discharge port. In the developing device, the disk portion and the helical blade of the second transport portion are arranged across a gap.

With the above configuration, as fresh developer is supplied into the developer container, the developer is, while being stirred, transported to the downstream side of a transport chamber by rotation of the first transport portion. As the reverse helical blade of the second transport portion rotates in the same direction as the first transport portion, a transport force is applied to the developer in the opposite direction to the developer transport direction by the first transport portion. By the transport force in the opposite direction, the developer is blocked, and increases its height; thus surplus developer moves over the second transport portion and the disk portion (regulating portion) into the developer discharge port and is discharged to the outside. Moreover, an end part of the helical blade of the second transport portion and the disk portion are arranged so as not to be joined to each other so as to stabilize the height of the developer inside the developer container.

SUMMARY

According to one aspect of the present disclosure, a developing device includes a developer container, a first stirring member, a second stirring member, and a developer carrying member. The developer container, for storing two-component developer containing carrier and toner, includes a plurality of transport chambers, including a first transport chamber and a second transport chamber, arranged side by side, a communication portion through which the first and second transport chambers communicate with each other in opposite end parts thereof in their longitudinal direction, a developer supply port through which developer is supplied into the developer container, and a developer discharge port through which surplus developer is discharged, the developer discharge port being arranged in a downstream-side end part of the second transport chamber. The first stirring member is composed of a rotary shaft and a first transport blade formed on the circumferential surface of the rotary shaft, and stirs and transports developer inside the first transport chamber in the axial direction of the rotary shaft. The second stirring member is composed of a rotary shaft and a second transport blade formed on the circumferential surface of the rotary shaft, and stirs and transports developer inside the second transport chamber in the opposite direction to the first stirring member. The developer carrying member is rotatably supported on the developer container, and carries the developer inside the second transport chamber on the surface of the developer carrying member. The second stirring member includes a regulating portion which is formed next to, on the downstream side of, the second transport blade with respect to the transport direction of the developer inside the second transport chamber and which is formed by a transport blade that transports developer in the opposite direction to the second transport blade, a discharge blade which is formed next to, on the downstream side of, the regulating portion with respect to the transport direction of the developer inside the second transport chamber and which transports developer in the same direction as the second transport blade so as to discharge the developer through the developer discharge port, a first disk which is formed between the second transport blade and the regulating portion and which protrudes in the radial direction around the entire circumference of the rotary shaft, and a second disk which is formed between the regulating portion and the discharge blade and which protrudes in the radial direction around the entire circumference of the rotary shaft.

Further features and advantages of the present disclosure will become apparent from the description of embodiments given below.

DETAILED DESCRIPTION

Figure 1:
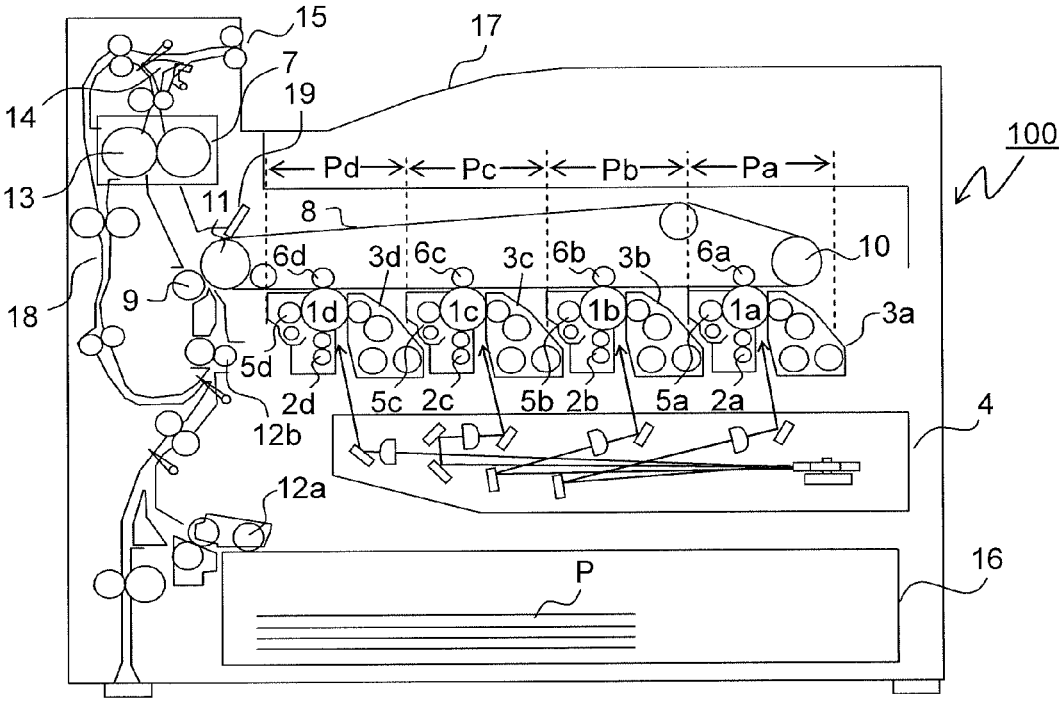
FIG. 1 is a schematic sectional view of a color printer 100 incorporating developing devices 3*a* to 3*d* according to the present disclosure.

Hereinafter, embodiments of the present disclosure will be described with reference to the accompanying drawings. FIG. 1 is a schematic sectional view of an image forming apparatus incorporating a developing device according to the present disclosure, here showing a tandem-type color printer. Inside the main body of the color printer 100, four image forming portions Pa, Pb, Pc, and Pd are arranged in this order from the upstream side with respect to the transport direction (the right side in FIG. 1). These image forming portions Pa to Pd are provided to correspond to images of four different colors (cyan, magenta, yellow, and black) respectively, and sequentially form cyan, magenta, yellow, and black images respectively, each through the processes of electrostatic charging, exposure to light, image development, and image transfer.

In these image forming portions Pa to Pd, there are respectively arranged photosensitive drums 1*a*, 1 *b*, 1*c* and 1*d* that carry visible images (toner images) of the different colors. Moreover, an intermediate transfer belt 8 that rotates in the clockwise direction in FIG. 1 by being driven by a driving means (unillustrated) is arranged next to the image forming portions Pa to Pd. Toner images formed on these photosensitive drums 1*a* to 1*d* are sequentially superimposed on each other and transferred to the intermediate transfer belt 8 that moves while being in contact with the photosensitive drums 1*a* to 1*d*. Thereafter, the toner images transferred to the intermediate transfer belt 8 are transferred all at once to a transfer sheet P by a secondary transfer roller 9. Then, the toner images are fixed to the transfer sheet P in a fixing portion 7, and the transfer sheet P is then discharged out of the apparatus main body. An image forming process is performed with respect to each of the photosensitive drums 1*a* to 1*d* while these are rotated in the counterclockwise direction in FIG. 1.

Transfer sheets P to which toner images are to be transferred are stored in a sheet feed cassette 16 in a lower part of the color printer 100, and are transported via a feeding roller 12*a* and a registration roller pair 12*b* to the secondary transfer roller 9. As the intermediate transfer belt 8, a dielectric resin sheet is used, which is, for example, a belt having opposite ends overlapped and bonded together into an endless shape, or a seamless belt having no seam. On the downstream side of the secondary transfer roller 9, a blade-shaped belt cleaner 19 is arranged for removing toner left unused on the surface of the intermediate transfer belt 8.

Now, the image forming portions Pa to Pd will be described. Around and under the photosensitive drums 1*a* to 1*d*, which are rotatably arranged, there are arranged charging devices 2*a*, 2*b*, 2*c*, and 2*d* for electrostatically charging the photosensitive drums 1*a* to 1*d*, an exposure unit 4 for exposing the photosensitive drums 1*a* to 1*d* to light based on image data, developing devices 3*a*, 3*b*, 3*c*, and 3*d* for forming toner images on the photosensitive drums 1*a* to 1*d*, and cleaning portions 5*a*, 5*b*, 5*c*, and 5*d* for removing developer (toner) left unused on the photosensitive drums 1*a* to 1*d*.

When an instruction to start image formation is fed in from a host device such as a personal computer, first, by the charging devices 2*a* to 2*d*, the surfaces of the photosensitive drums 1*a* to 1*d* are electrostatically charged uniformly. Then, by the exposure unit 4, the surfaces of the photosensitive drums 1*a* to 1*d* are irradiated with light, and thereby electrostatic latent images based on an image signal are formed on the photosensitive drums 1*a* to 1*d* respectively. The developing devices 3*a* to 3*d* are charged with predetermined amounts of toner of different colors, namely cyan, magenta, yellow, and black respectively, by a supplying device (unillustrated). The toner is fed from the developing devices 3*a* to 3*d* onto the photosensitive drums 1*a* to 1*d*, and electrostatically attaches to it, thereby forming toner images based on the electrostatic latent images formed by exposure to light from the exposure unit 4.

Then, after an electric field has been applied to the intermediate transfer belt 8 with a predetermined transfer voltage, by primary transfer rollers 6*a* to 6*d*, the cyan, magenta, yellow, and black toner images on the photosensitive drums 1*a* to 1*d* are transferred to the intermediate transfer belt 8. These images of four colors are formed in a predetermined positional relationship prescribed to form a predetermined full-color image. Thereafter, in preparation for subsequent formation of new electrostatic latent images, toner left unused on the surfaces of the photosensitive drums 1*a* to 1*d* is removed by the cleaning portions 5*a* to 5*d*.

The intermediate transfer belt 8 is wound around a plurality of tension rollers including a transport roller 10 on the upstream side and a driving roller 11 on the downstream side. As the driving roller 11 rotates by being driven by a driving motor (unillustrated), the intermediate transfer belt 8 rotates in the clockwise direction; meanwhile, a transport sheet P is transported from the registration roller pair 12*b*, with predetermined timing, to the secondary transfer roller 9 arranged next to the intermediate transfer belt 8 so that a full-color image is transferred to the transport sheet P. The transfer sheet P having the toner images transferred to it is transported to the fixing portion 7.

The transfer sheet P transported to the fixing portion 7 is then heated and pressed there by a fixing roller pair 13 so that the toner images are fixed to the surface of the transport sheet P to form the predetermined full-color image. The transfer sheet P having the full-color image formed on it is distributed between different transport directions by a branching portion 14 which branches into a plurality of directions. When an image is formed only on one side of the transfer sheet P, the transfer sheet P is discharged, as it is, onto a discharge tray 17 by a discharge roller pair 15.

On the other hand, when images are formed on both sides of the transfer sheet P, a part of the transfer sheet P having passed through the fixing portion 7 is stuck out of the apparatus via the discharge roller pair 15. Thereafter, the discharge roller pair 15 is rotated in the reverse direction so that the transfer sheet P is distributed into a reversed transport passage 18 by the branching portion 14; thus the transfer sheet is, with the image side reversed, transported once again to the registration roller pair 12*b*. Then, the next image formed on the intermediate transfer belt 8 is transferred by the secondary transfer roller 9 to the side of the transfer sheet P on which no image has yet been formed. The transfer sheet P is then transported to the fixing portion 7, where the toner image is fixed, and is then discharged via the discharge roller pair 15 onto the discharge tray 17.

Figure 2:
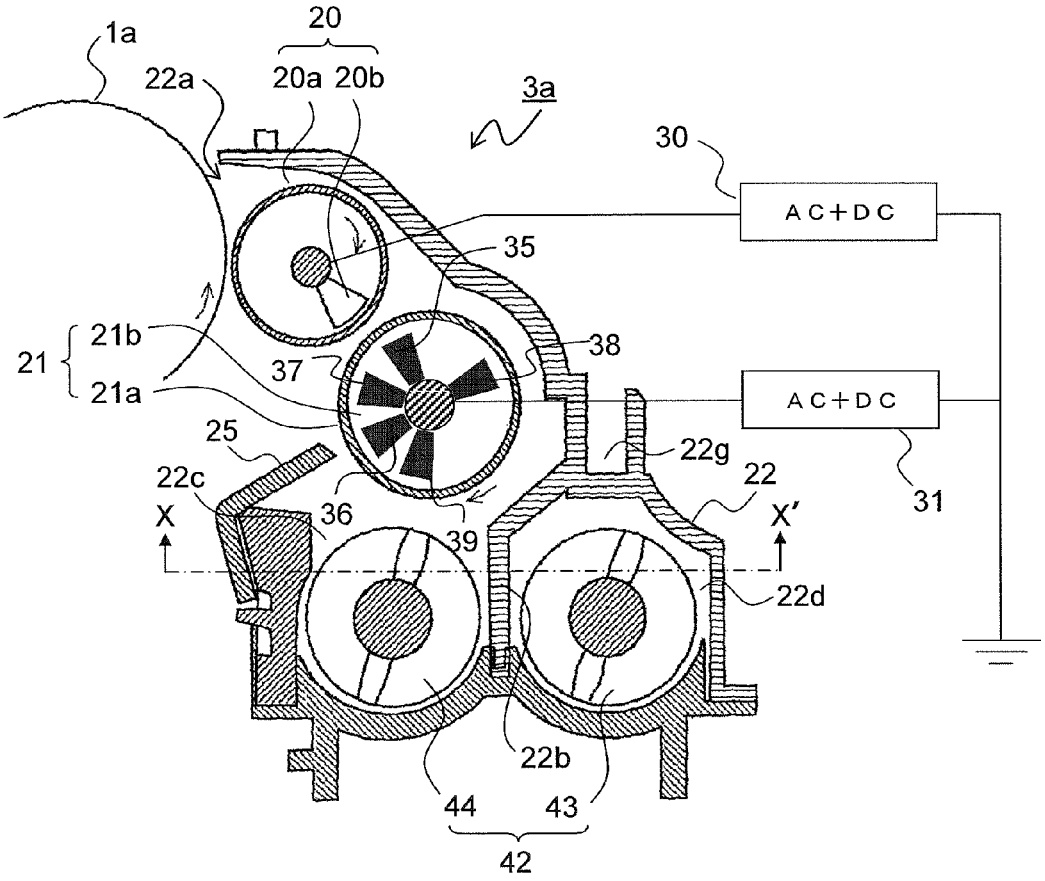
FIG. 2 is a side sectional view of a developing device 3*a* according to one embodiment of the present disclosure.

FIG. 2 is a side sectional view showing a structure of the developing device 3*a* incorporated in the color printer 100. Although the following description deals with the developing device 3*a* arranged in the image forming portion Pa in FIG. 1, the developing devices 3*b* to 3*d* arranged in the image forming portions Pb to Pd have basically the same structure, and thus no overlapping description will be repeated.

As shown in FIG. 2, the developing device 3*a* includes a developer container 22 for storing two-component developer (hereinafter, also referred to simply as developer). The developer container 22 has an opening 22*a* formed in it through which a developing roller 20 is exposed toward the photosensitive drum, and is divided into first and second transport chambers 22*c* and 22*d* by a partition wall 22*b*. In the first and second transport chambers 22*c* and 22*d*, there is rotatably arranged a stirring member 42, composed of a first stirring screw 43 and a second stirring screw 44, for mixing and stirring toner (positively charged toner) fed from an unillustrated toner container with carrier and for electrostatically charging the toner.

Then, by the first stirring screw 43 and the second stirring screw 44, developer is transported, while being stirred, in the axial direction, to circulate between the first and second transport chambers 22*c* and 22*d* via communication portions 22*e* and 22*f* (see FIG. 4) formed on opposite end parts of the partition wall 22*b*. In the example shown in FIGS. 2 and 4, the developer container 22 extends obliquely to the upper left side; in the developer container 22, a magnetic roller 21 is arranged over the second stirring screw 44, and a developing roller 20 is arranged opposite the magnetic roller 21, obliquely on the upper left of it. Moreover, the developing roller 20 is arranged opposite the photosensitive drum 1*a*, beside the opening 22*a* in the developer container 22 (on the left side in FIG. 2). The magnetic roller 21 and the developing roller 20 rotate in the clockwise direction in FIG. 2.

In the developer container 22, a toner concentration sensor (unillustrated) is arranged to face the first stirring screw 43. According to the toner concentration detected by the toner concentration sensor, toner is supplied from the supplying device (unillustrated) through a toner supply port 22*g* into the developer container 22.

The magnetic roller 21 is composed of a non-magnetic rotary sleeve 21*a* and a fixed magnet member 21*b* housed in the rotary sleeve 21*a* and having a plurality of magnetic poles. In the present embodiment, the magnetic poles of the fixed magnet member 21*b* include five poles, namely a main pole 35, a regulating pole (magnetic pole for trimming) 36, a transporting pole 37, a peeling pole 38, and a scooping pole 39. A predetermined gap is secured between the magnetic roller 21 and the developing roller 20 at their facing position (opposing position) at which they face each other.

To the developer container 22, a trimming blade 25 is fitted along the longitudinal direction of the magnetic roller 21 (the direction perpendicular to the plane of FIG. 2). The trimming blade 25 is positioned, with respect to the rotation direction of the magnetic roller 21 (the clockwise direction in FIG. 2), on the upstream side of the opposing position of the developing roller 20 and the magnetic roller 21. Moreover, a small gap is formed between a tip end part of the trimming blade 25 and the surface of the magnetic roller 21.

The developing roller 20 is composed of a non-magnetic developing sleeve 20*a* and a developing roller-side magnetic pole 20*b* fixed in the developing sleeve 20*a*. The developing roller-side magnetic pole 20*b* has the opposite polarity to that of the magnetic pole (main pole) 35 of the fixed magnet member 21*b*, the developing roller-side magnetic pole 20*b* facing the magnetic pole 35.

To the developing roller 20, a first bias circuit 30 is connected for applying to it a DC bias (hereinafter referred to as Vslv (DC)) and an AC bias (hereinafter referred to as Vslv (AC)). To the magnetic roller 21, a second bias circuit 31 is connected for applying to it a DC bias (hereinafter referred to as Vmag (DC)) and an AC bias (hereinafter Vmag (AC)). Moreover, the first bias circuit 30 and the second bias circuit 31 are connected to a common ground.

As described above, by the first stirring screw 43 and the second stirring screw 44, developer is transported, while being stirred, to circulate in the developer container 22 while toner is electrostatically charged; by the second stirring screw 44, the developer is transported to the magnetic roller 21. Since the regulating pole 36 of the fixed magnet member 21*b* faces the trimming blade 25, by use of a non-magnetic member or a magnetic member having the polarity opposite to the regulating pole 36 as the trimming blade 25, a magnetic field is produced in the gap between the tip end part of the trimming blade 25 and the rotary sleeve 21*a* in a direction in which these attract each other.

With this magnetic field, a magnetic brush is formed between the trimming blade 25 and the rotary sleeve 21*a*. The magnetic brush on the magnetic roller 21 has its layer thickness regulated by the trimming blade 25, and then moves to a position facing the developing roller 20; there, to the magnetic brush, an magnetic field is applied in a direction in which the main pole 35 of the fixed magnet member 21*b* and the developing roller-side magnetic pole 20*b* attract each other, and thus the magnetic brush makes contact with the surface of the developing roller 20. Then, by this magnetic field and by the potential difference ΔV between the Vmag(DC) applied to the magnetic roller 21 and the Vslv(DC) applied to the developing roller 20, a thin layer of toner is formed on the developing roller 20.

The thickness of the toner layer on the developing roller 20 varies according to the resistance of developer, the difference in rotation speed between the magnetic roller 21 and the developing roller 20, etc., but can be controlled by controlling the potential difference ΔV. Increasing the potential difference ΔV makes the layer of toner on the developing roller 20 thicker, and decreasing the potential difference ΔV makes the layer of toner thinner. A proper range of the potential difference ΔV during development is from 100V to 350V.

Figure 3A:
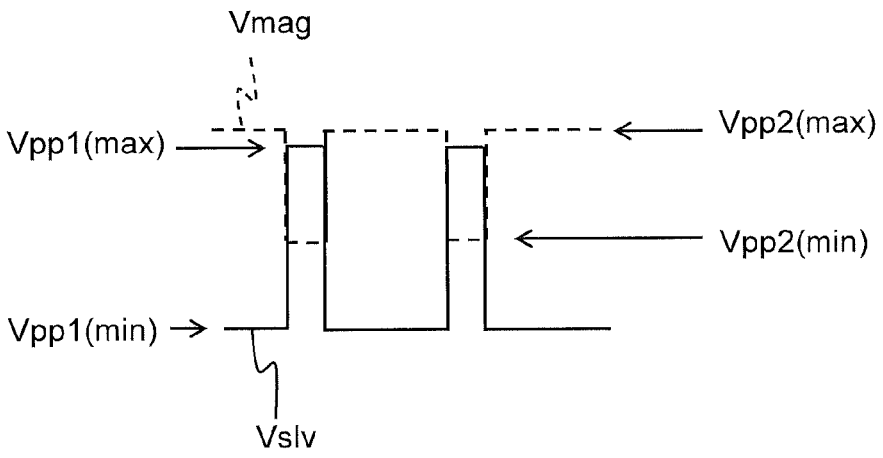
FIG. 3A is a diagram showing an example of a waveform of a bias applied to a developing roller 20.
Figure 3B:
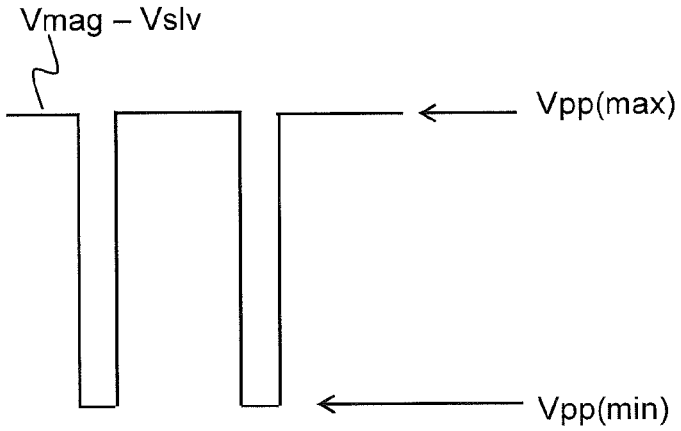
FIG. 3B is a diagram showing an example of a waveform of a bias applied between a magnetic roller 21 and a developing roller 20.

FIGS. 3A and 3B are diagrams showing an example of the waveforms of the biases applied to the developing roller 20 and to the magnetic roller 21. As shown in FIG. 3A, to the developing roller 20, a composite waveform Vslv (solid line) is applied by the first bias circuit 30. The composite waveform Vslv has rectangular waves Vslv(AC) with a peak-to-peak value Vpp1 superimposed on a DC voltage Vslv(DC). To the magnetic roller 21, a composite waveform Vmag (broken-line) is applied by the second bias circuit 31. The composite waveform Vmag has rectangular waves Vmag(AC) with a peak-to-peak value Vpp2 and with the opposite phase to that of the Vslv(AC) superimposed on a DC voltage and with Vmag(DC).

Thus, the voltage applied between the magnetic roller 21 and the developing roller 20 (hereinafter referred to as across the MS interval) has a composite waveform Vmag-Vslv having peak voltages Vpp(max) and Vpp(min) as shown in FIG. 3B. Here, Vmag(AC) is set so as to have a duty ratio larger than that of Vslv(AC). The AC bias that is actually applied is not perfectly rectangular waves as shown in FIGS. 3A and 3B, but has a partly distorted waveform.

The thin layer of toner formed on the developing roller 20 by the magnetic brush is transported, by the rotation of the developing roller 20, to a part at which the photosensitive drum 1*a* and the developing roller 20 face each other. Since Vslv(DC) and Vslv(AC) are applied to the developing roller 20, due to the potential difference between the developing roller 20 and the photosensitive drum 1*a*, toner flies to the photosensitive drum 1*a* so that an electrostatic latent image on it is developed.

As the rotary sleeve 21*a* rotates farther in the clockwise direction, by a magnetic field produced in the horizontal direction (the roller circumferential direction), this time, by the peeling pole 38 which is arranged next to the main pole 35 and which has the opposite polarity to the main pole 35, the magnetic brush is separated from the surface of the developing roller 20, and toner left unused during development is collected from the developing roller 20 onto the rotary sleeve 21*a*. As the rotary sleeve 21*a* rotates farther, a magnetic field is applied in a direction in which, of the fixed magnet member 21*b*, the peeling pole 38 and the scooping pole 39, which has the same polarity as the peeling pole 38, repel each other, and thus toner leaves the rotary sleeve 21*a* within the developer container 22. Then, after being stirred and transported by the second stirring screw 44, the toner is again, as two-component developer which has a proper toner concentration and which is electrostatically charged uniformly, formed by the scooping pole 39 into a magnetic brush on the rotary sleeve 21*a*, and is transported to the trimming blade 25.

Figure 4:
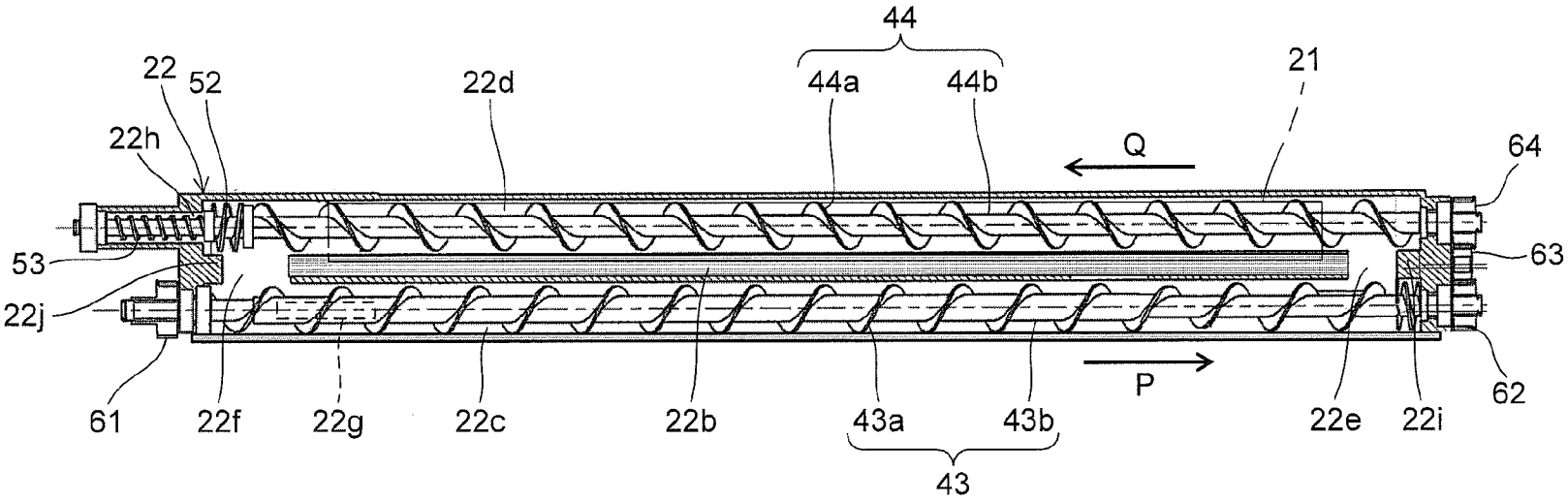
FIG. 4 is a sectional plan view of a stirring portion in a developing device 3*a* according to the present embodiment.

Next, the structure of a stirring portion in the developing device 3*a* will be described in detail. FIG. 4 is a sectional plan view (as seen from the direction indicated by arrows X and X' in FIG. 2) of the stirring portion in the developing device 3*a*.

In the developer container 22, as described previously, there are formed the first transport chamber 22*c*, the second transport chamber 22*d*, the partition wall 22*b*, the upstream-side communication portion 22*e*, and the downstream-side communication portion 22*f*; there are further formed a developer supply port 22*g*, a developer discharge port 22*h*, an upstream-side wall portion 22*i*, and a downstream-side wall portion 22*j*. With respect to the first transport chamber 22*c*, the left side in FIG. 4 is the upstream side and the right side in FIG. 4 is the downstream side; with respect to the second transport chamber 22*d*, the right side in FIG. 4 is the upstream side and the left side in FIG. 4 is the downstream side. Thus, the communication portions and the side wall portions are distinguished between the upstream-side and downstream-side ones relative to the second transport chamber 22*d*.

The partition wall 22*b* extends in the longitudinal direction of the developer container 22 to separate the first transport chamber 22*c* and the second transport chamber 22*d* such that these lie side by side. A right end part of the partition wall 22*b* in the longitudinal direction forms the upstream-side communication portion 22*e* together with an inner wall part of the upstream-side wall portion 22*i*. On the other hand, a left end part of the partition wall 22*b* in the longitudinal direction forms the downstream-side communication portion 22*f* together with an inner wall part of the downstream-side wall portion 22*j*. Thus, developer can circulate through the first transport chamber 22*c*, the upstream-side communication portion 22*e*, the second transport chamber 22*d*, and the downstream-side communication portion 22*f*.

The developer supply port 22*g* is an opening through which fresh toner and carrier are supplied from a developer supply container (unillustrated) provided over the developer container 22 into the developer container 22. The developer supply port 22*g* is arranged on the upstream side (the left side in FIG. 4) of the first transport chamber 22*c*.

The developer discharge port 22*h* is an opening through which surplus developer in the first and second transport chambers 22*c* and 22*d* resulting from supply of fresh developer is discharged. The developer discharge port 22*h* is arranged continuous with the second transport chamber 22*d* in the longitudinal direction, on the downstream side of the second transport chamber 22*d*.

In the first transport chamber 22*c*, the first stirring screw 43 is arranged; in the second transport chamber 22*d*, the second stirring screw 44 is arranged.

The first stirring screw 43 has a rotary shaft 43*b* and a first helical blade 43*a* provided integrally with the rotary shaft 43*b* and formed in a helical shape with a predetermined pitch in the axial direction of the rotary shaft 43*b*. The first helical blade 43*a* extends up to opposite end parts of the first transport chamber 22*c* in the longitudinal direction, and is arranged to face the upstream-side and downstream-side communication portions 22*e* and 22*f*. The rotary shaft 43*b* is rotatably supported on the upstream-side wall portion 22*i* and the downstream-side wall portion 22*j* of the developer container 22.

The second stirring screw 44 has a rotary shaft 44*b* and a second helical blade 44*a* provided integrally with the rotary shaft 44*b* and formed in a helical shape spiraling in the opposite direction (in the opposite phase) to the first helical blade 43*a* with the same pitch as the first helical blade 43*a* in the axial direction of the rotary shaft 44*b*. The second helical blade 44*a* has a length larger than that of the magnetic roller 21 in the axial direction, and is arranged so as to extend up to a position facing the upstream-side communication portion 22*e*. The rotary shaft 44*b* is arranged parallel to the rotary shaft 43*b* and is rotatably supported on the upstream-side wall portion 22*i* and the downstream-side wall portion 22*j* of the developer container 22.

Moreover, on the rotary shaft 44*b*, a regulating portion 52 and a discharge blade 53 are integrally arranged together with the second helical blade 44*a*.

The regulating portion 52 makes it possible to block the developer transported to the downstream side inside the second transport chamber 22*d* and to transport the developer to the developer discharge port 22*h* when the amount of developer exceeds a predetermined amount. The regulating portion 52 comprises a helical blade arranged on the rotary shaft 44*b* and is formed in a helical shape spiraling in the opposite direction (in the opposite phase) to the second helical blade 44*a*. The regulating portion 52 is configured to have substantially the same outer diameter as, but a smaller pitch than, the second helical blade 44*a*. Moreover, the regulating portion 52 forms a predetermined gap between an inner wall part of the developer container 22, such as the downstream-side wall portion 22*j*, and an outer circumferential part of the regulating portion 52. Through this gap, surplus developer is discharged through the developer discharge port 22*h*.

The rotary shaft 44*b* extends into the developer discharge port 22*h*. On the rotary shaft 44*b* in the developer discharge port 22*h*, the discharge blade 53 is arranged. The discharge blade 53 comprises a helical blade spiraling in the same direction as the second helical blade 44*a*, but has a smaller pitch and a smaller blade circumference than the second helical blade 44*a*. Thus, as the rotary shaft 44*b* rotates, the discharge blade 53 also rotates so that the surplus developer transported into the developer discharge port 22*h* over the regulating portion 52 is transported to the left side in FIG. 4 to be discharged out of the developer container 22. The discharge blade 53, the regulating portion 52, and the second helical blade 44*a* are formed integrally with the rotary shaft 44*b* out of synthetic resin.

On an outer wall of the developer container 22, gears 61 to 64 are arranged. The gears 61 and 62 are fixed on the rotary shaft 43*b*, and the gear 64 is fixed on the rotary shaft 44*b*. The gear 63 is rotatably held on the developer container 22 to mesh with the gears 62 and 64.

During development, during which period no fresh developer is supplied, as the gear 61 rotates by the action of a driving source such as a motor, the first helical blade 43*a* rotates together with the rotary shaft 43*b*. By the first helical blade 43*a*, the developer in the first transport chamber 22*c* is transported in the main transport direction (the direction indicated by arrow P), and the developer is then transported through the upstream-side communication portion 22*e* into the second transport chamber 22*d*. Moreover, as the second helical blade 44*a* rotates together with the rotary shaft 44*b* which follows the rotary shaft 44*a*, by the second helical blade 44*a*, the developer in the second transport chamber 22*d* is transported in the main transport direction (the direction indicated by arrow Q). Thus, the developer is, while greatly varying its height, transported from the first transport chamber 22*c* through the upstream-side communication portion 22*e* into the second transport chamber 22*d*, and the developer is then, without going over the regulating portion 52, transported through the downstream-side communication portion 22*f* to the first transport chamber 22*c*.

In this way, developer, while being stirred, circulates through the first transport chamber 22*c*, the upstream-side communication portion 22*e*, the second transport chamber 22*d*, and the downstream-side communication portion 22*f*, and the stirred developer is fed to the magnetic roller 21.

Next, how developer is supplied through the developer supply port 22*g* will be described. As toner is consumed in development, developer containing carrier is supplied through the developer supply port 22*g* into the first transport chamber 22*c*.

The supplied developer is, as during development, transported in the direction indicated by arrow P inside the first transport chamber 22*c* by the first helical blade 43*a*, and the developer is then transported through the upstream-side communication portion 22*e* into the second transport chamber 22*d*. Moreover, by the second helical blade 44*a*, the developer in the second transport chamber 22*d* is transported in the main transport direction (the direction indicated by arrow Q). As the regulating portion 52 rotates together with the rotary shaft 44*b*, a transporting force in the direction opposite to the main transport direction (the opposite transport direction) is applied to the developer by the regulating portion 52. The developer increases its height by being blocked by the regulating portion 52, and the surplus developer (the same amount as the amount of developer supplied through the developer supply port 22*g*) goes over the regulating portion 52 and is discharged via the developer discharge port 22*h* out of the developer container 22.

Figure 5:
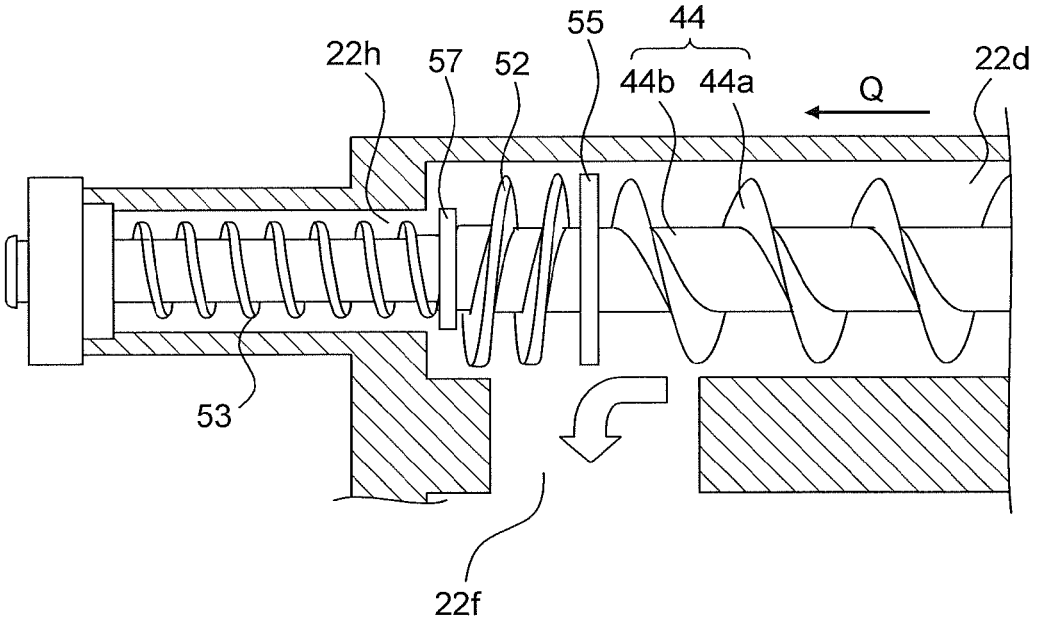
FIG. 5 is an enlarged view of and around a developer discharge port 22*h* in FIG. 4.

FIG. 5 is an enlarged view of and around the developer discharge port 22*h* in FIG. 4. As shown in FIG. 5, on the second stirring screw 44, a first disk 55 is arranged between the second helical blade 44*a* and the regulating portion 52. Moreover, a second disk 57 is arranged between the regulating portion 52 and the discharge blade 53. The first disk 55 and the second disk 57 are, together with the second helical blade 44*a*, the regulating portion 52, and the discharge blade 53, formed integrally with the rotary shaft 44*b* out of synthetic resin.

With the configuration according to the present disclosure, the transporting force with which developer is transported in the main transport direction (the direction indicated by arrow Q) by the second helical blade 44*a* is temporarily blocked and weakened by the first disk 55. Then, a transporting force is applied to the developer in the opposite direction by the regulating portion 52, and the developer is pushed back in the opposite direction to the main transport direction. That is, the first disk 55 serves to reduce the transporting force (pressure) with which the developer is transported from the second transport chamber 22*d* to the regulating portion 52. As a result, it is possible to prevent ruffling (fluctuation) at the surface of the developer moving to the regulating portion 52 and the downstream-side communication portion 22*f*, and thus to make a substantially constant amount of developer stay in the vicinity of the regulating portion 52 irrespective of the transport speed of the developer.

When the outer diameter of the first disk 55 is larger than the outer diameter of the second helical blade 44*a*, an excessive effect to block the developer transported by the second helical blade 44*a* results; this makes it difficult for the developer to move to the regulating portion 52. Thus, the outer diameter of the first disk 55 preferably is equal to or smaller than the outer diameter of the second helical blade 44*a*.

When developer is supplied through the developer supply port 22*g* and the height of the developer inside the developer container 22 increases, the pressure is reduced by the first disk 55, and the developer staying in the vicinity of the regulating portion 52 moves over the second disk 57 to the discharge blade 53 (the developer discharge port 22*h*) so that surplus developer is discharged through the developer discharge port 22*h*. That is, the second disk 57 serves to adjust the amount of developer which, out of the developer staying in the vicinity of the regulating portion 52, moves to the developer discharge port 22*h*. Just because the developer moving from the regulating portion 52 to the developer discharge port 22*h* is blocked by the second disk 57, it does not follow that all the developer that goes over the regulating portion 52 reaches the discharge blade 53; part of the developer is pushed back to the downstream-side communication portion 22*f* from the regulating portion 52 to return to a developer circulating passage (indicated by an arrow in FIG. 5).

Since the second disk 57 serves to regulate the amount of developer that moves from the regulating portion 52 to the discharge blade 53, its effect to block the developer may be weaker than that of the first disk 55 that reduces the transporting force with which developer is transported by the second helical blade 44*a*. Accordingly, the outer diameter of the second disk 57 preferably is equal to or smaller than the outer diameter of the first disk 55. Moreover, by varying the outer diameter of the second disk 57, the amount of developer discharged through the developer discharge port 22*h* can be adjusted.

As described above, with the first disk 55, it is possible to block the developer moving from the second transport chamber 22*d* to the regulating portion 52, and thereby to reduce the transporting force of the developer so as to make the developer stay in the vicinity of the regulating portion 52. Moreover, with the second disk 57, it is possible to block the developer moving from the regulating portion 52 to the developer discharge port 22*h*, and thereby to adjust the amount of developer discharged through the developer discharge port 22*h*. Thus, even when the fluidity and the transport speed of the developer inside the second transport chamber 22*d* vary, the stable developer amount inside the developer container 22 can be kept substantially constant.

By incorporating developing devices 3*a* to 3*d* according to the present disclosure in a plurality of types of image forming apparatuses 100 having different process speeds, it is possible to eliminate the need to change the design and specifications of the developing devices 3*a* to 3*d* according to the different process speeds.

In an image forming apparatus whose driving speed can be switched between two levels according to the thickness and kind of the recording medium that is transported, for example, when plain paper is used as the recording medium, image formation is performed at an ordinary driving speed (hereinafter referred to as a full speed mode); when thick paper is used as the recording medium, image formation is performed at a speed lower than the ordinary speed (hereinafter referred to as a reduced-speed mode) so as to secure a sufficient fixing time with a view to improving image quality. In such an image forming apparatus, switching from the full speed mode to the reduced-speed mode causes a sharp change in the transport speed of developer inside the developer container 22. In such a case, by incorporating the developing devices 3*a* to 3*d* according to the present disclosure, it is possible to keep the stable developer amount in the developer container 22 substantially constant in both of the full speed mode and the reduced-speed mode.

The embodiment described above is in no way meant to limit the present disclosure, which thus allows for many modifications and variations within the spirit of the present disclosure. For example, the present disclosure is applicable, not only to a developing device provided with a magnetic roller 21 and a developing roller 20 as shown in FIG. 2, but also to various developing devices that use two-component developer that contains carrier and toner. For example, although the above-described embodiment deals with a two-axis transport type developing device provided with a first transport chamber 22*c* and a second transport chamber 22*d* arranged side by side as developer circulating passages in a developer container 22, the present disclosure is applicable also to a three-axis transport type developing device provided additionally with a collecting transport chamber in which developer removed from the magnetic roller 21 is collected to be fed back to the second transport chamber 22*d*.

In the above-described embodiment, use is made of the first stirring screw 43 composed of the first helical blade 43*a* continuously arranged on the circumferential surface of the rotary shaft 43*b* and the second stirring screw 44 composed of the second helical blade 44*a* continuously arranged on the circumferential surface of the rotary shaft 44*b*; however, the transport blade that transports developer is not limited to a helical blade; instead, use may also be made of, for example, a stirring/transporting member composed of a plurality of semicircular disks (circular disks divided in halves) alternatively arranged with a predetermined inclination angle on the circumferential surfaces of the rotary shafts 43*b* and 44*b*.

Moreover, the present disclosure is applicable, not only to tandem-type monochrome printers like the one shown in FIG. 1, but also to various image forming apparatuses adopting a two-component developing system, such as digital and analog monochrome copiers, monochrome printers, color copiers, facsimile machines, etc. Below, by way of practical examples, the effects of the present disclosure will be described more specifically.

Practical Example

With a color printer 100 as shown in FIG. 1, how the amount of developer in the developing devices 3*a* to 3*d* varies as the transport speed of developer, the toner concentration in developer, and the absolute humidity are varied was examined. The experiment was performed with respect to the image forming portion Pa for cyan that included the photosensitive drum 1*a* and the developing device 3*a*.

Figure 6:
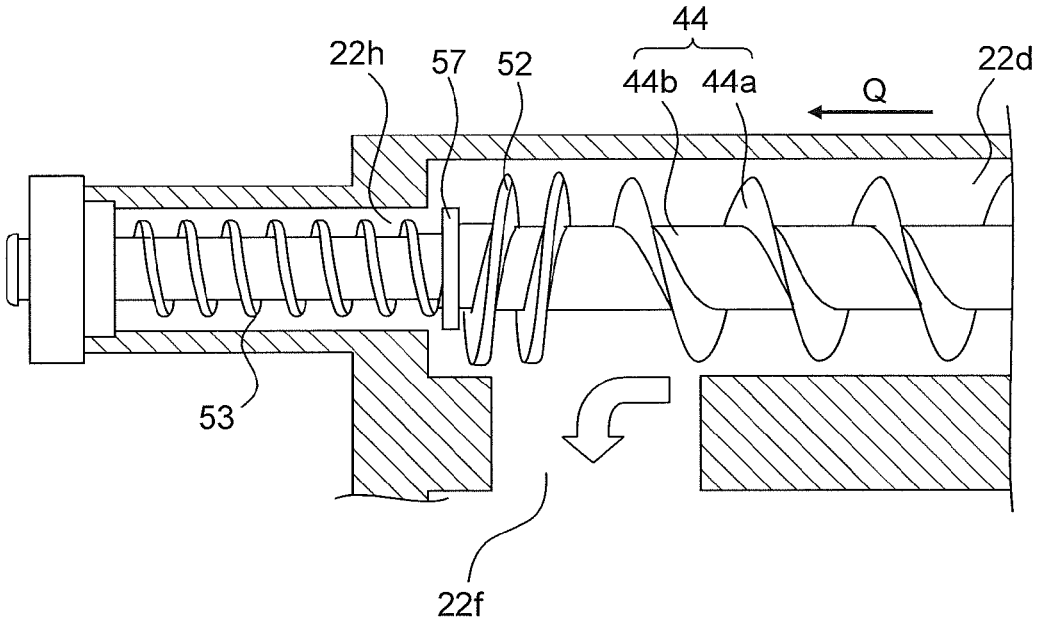
FIG. 6 is an enlarged view of and around a developer discharge port 22*h* in a developing device 3*a* according to comparative example.

In the experiment, a developing device 3*a* as shown in FIG. 5 in which a second helical blade 44*a*, a regulating portion 52, a discharge blade 53, a first disk 55, and a second disk 57 were arranged on the rotary shaft 44*b* of the second stirring screw 44 was taken as practical examples 1 and 2 of the present disclosure. On the other hand, a developing device 3*a* as shown in FIG. 6 in which a second helical blade 44*a*, a regulating portion 52, a discharge blade 53, and a second disk 57 were arranged on the rotary shaft 44*b* was taken as comparative example.

The second helical blade 44*a* of the second stirring screw 44 used in practical examples 1 and 2 and in comparative example was a helical blade with an outer diameter of 14 mm, a pitch of 30 mm, and a gap (clearance) of 1.5 mm from the second transport chamber 22*d*. The regulating portion 52 was composed of two turns of helical blades spiraling in opposite directions (opposite phases) with an outer diameter of 12 mm and a pitch of 5 mm, and had a gap of 2.5 mm from the second transport chamber 22*d*. The discharge blade 53 was a helical blade with an outer diameter of 8 mm and a pitch of 5 mm, and had a gap of 1.5 mm from the developer discharge port 22*h*.

The first disk 55 used in practical examples 1 and 2 was a disk with an outer diameter of 12 mm and a gap of 2.5 mm from the second transport chamber 22*d*. The second disk 57 used in practical example 1 had an outer diameter of 8 mm and a gap of 4.5 mm from the second transport chamber 22*d*. The second disk 57 used in practical example 2 had an outer diameter of 12 mm and a gap of 2.5 mm from the second transport chamber 22*d*. The second disk 57 used in comparative example had an outer diameter of 12 mm and a gap of 2.5 mm from the second transport chamber 22*d*.

The developer containers 22 of the developing devices 3*a* according to practical examples 1 and 2 and according to comparative example were each charged with 150 $cm^3$ of developer. The rotation speed of the first stirring screws 43 was fixed at 300 rpm while the rotation speed of the second stirring screws 44 was varied. The developer was stirred and transported inside each of those developer containers 22, and when the discharge of the developer through the developer discharge ports 22*h* ceased, the amounts (stable weights, stable volumes) of developer that were present in the developer containers 22 were measured.

The amounts of developer were measured as follows. The developing devices 3*a* according to practical examples and according to comparative example were incorporated in testing devices. The rotation speed of the second stirring screws 44 (the stirring speed inside the second transport chambers 22*d*), the toner concentration, the absolute humidity, and the value of an AC bias applied to the second stirring screws 44 were varied, and the developer was stirred. Then, the weights were measured with the developing devices 3*a* removed. The amounts (stable weights) of developer were calculated by subtracting the weights of the empty developing devices 3*a* without developer from the measured weights of the developing devices 3*a*. The stable volumes were calculated by dividing the calculated amounts of developer by bulk densities. Table 1 shows the relationship among the absolute humidity, the toner concentration (the mixing ratio of toner to carrier; T/C), and the bulk density as used for calculations of the stable volumes.

Taken as reference conditions were a stirring speed of 300 rpm, a toner concentration of 10%, and an absolute humidity of 10 g/m$^3$. The stirring speed was varied among three levels: 200 rpm, 300 rpm, and 400 rpm. The toner concentration was varied among three levels: 8%, 10%, and 12%. The absolute humidity was varied among three levels: 5 g/m$^3$, 10 g/m$^3$, and 20 g/m$^3$. Tables 2 to 5 show the results.

TABLE 1

| Absolute Humidity [g/m$^3$] | Toner Concentration [weight %] | Bulk Density [g/cm$^3$] |
|---|---|---|
| 5 | 8 | 1.73 |
| | 10 | 1.65 |
| | 12 | 1.58 |
| 10 | 8 | 1.86 |
| | 10 | 1.77 |
| | 12 | 1.69 |
| 20 | 8 | 1.93 |
| | 10 | 1.89 |
| | 12 | 1.84 |

TABLE 2

| Stirring | Toner | Absolute | Practical Example 1 | | Practical Example 2 | | Comparative Example | |
|---|---|---|---|---|---|---|---|---|
| Speed [rpm] | Concentration [weight %] | Humidity [g/m$^3$] | Volume [cm$^3$] | Weight [g] | Volume [cm$^3$] | Weight [g] | Volume [cm$^3$] | Weight [g] |
| 300 | 10 | 10 | 127 | 225 | 140 | 248 | 119 | 211 |

TABLE 3

| Stirring | Toner | Absolute | Practical Example 1 | | Practical Example 2 | | Comparative Example | |
|---|---|---|---|---|---|---|---|---|
| Speed [rpm] | Concentration [weight %] | Humidity [g/m$^3$] | Volume [cm$^3$] | Weight [g] | Volume [cm$^3$] | Weight [g] | Volume [cm$^3$] | Weight [g] |
| 200 | 10 | 10 | 130 | 230 | 144 | 255 | 123 | 218 |
| 300 | 10 | 10 | 127 | 225 | 140 | 248 | 118 | 209 |
| 400 | 10 | 10 | 126 | 223 | 139 | 246 | 115 | 204 |

TABLE 4

| Stirring | Toner | Absolute | Practical Example 1 | | Practical Example 2 | | Comparative Example | |
|---|---|---|---|---|---|---|---|---|
| Speed [rpm] | Concentration [weight %] | Humidity [g/m$^3$] | Volume [cm$^3$] | Weight [g] | Volume [cm$^3$] | Weight [g] | Volume [cm$^3$] | Weight [g] |
| 300 | 8 | 10 | 126 | 234 | 141 | 262 | 119 | 221 |
| 300 | 10 | 10 | 127 | 225 | 140 | 248 | 118 | 209 |
| 300 | 12 | 10 | 129 | 218 | 143 | 242 | 121 | 204 |

TABLE 5

| Stirring | Toner | Absolute | Practical Example 1 | | Practical Example 2 | | Comparative Example | |
|---|---|---|---|---|---|---|---|---|
| Speed [rpm] | Concentration [weight %] | Humidity [g/m$^3$] | Volume [cm$^3$] | Weight [g] | Volume [cm$^3$] | Weight [g] | Volume [cm$^3$] | Weight [g] |
| 300 | 10 | 5 | 127 | 210 | 139 | 229 | 115 | 190 |
| 300 | 10 | 10 | 127 | 225 | 140 | 248 | 118 | 209 |
| 300 | 10 | 20 | 129 | 244 | 141 | 266 | 119 | 225 |

As will be clear from Table 2, comparing the amounts of developer among practical examples 1 and 2 and comparative example under the reference conditions reveals that larger amounts of developer were observed in practical examples 1 and 2 than in comparative example. This is because, in the configurations according to practical examples 1 and 2, owing to the first disk 55 being present between the second helical blade 44*a* and the regulating portion 52, the transporting force with which developer was transported by the second helical blade 44*a* was temporarily weakened, with the result that less developer moved over the regulating portion 52 and the second disk 57 to the discharge blade 53.

Comparing the amounts of developer between practical examples 1 and 2 reveals that larger amounts of developer were observed in practical example 2 than in practical example 1. This is because the outer diameter of the second disk 57 in practical example 2 was larger than that in practical example 1, with the result that less developer moved over the second disk 57 to the discharge blade 53.

As will be clear from Table 3, varying the stirring speed of developer resulted in smaller variations in the stable volumes and stable weights of developer due to variation in the stirring speed in practical examples 1 and 2 than in comparative example. The reason is considered to be as follows. In the developing devices 3*a* according to practical examples 1 and 2 in which the first disk 55 and the second disk 57 were provided, the effect (buffer effect) to make the developer stay by reducing the transporting speed at which the developer passes over the regulating portion 52 present between the first disk 55 and the second disk 57 was so strong that, even when the stirring speed is varied, an effect to keep the height of the developer constant was obtained.

As will be clear from Tables 4 and 5, varying the toner concentration or the absolute humidity resulted in no variations observed in the stable volumes of developer in any of practical examples 1 and 2 and comparative example. On the other hand, the stable weights of developer in all of those examples decreased with an increase in the toner concentration and with a decrease in the absolute humidity, and increased with a decrease in the toner concentration and with an increase in the absolute humidity. This is because the charge amount of toner varied due to variations in the toner concentration and the absolute humidity, specifically because, as shown in Table 1, the lower the toner concentration was and the higher the absolute humidity was, the higher the bulk density of developer was.

As will be clear from Table 5, varying the absolute humidity resulted in slightly smaller variations in the stable volumes of developer in practical examples 1 and 2 than in comparative example. The reason is considered to be as follows. In the developing devices 3*a* according to practical examples 1 and 2 in which the first disk 55 and the second disk 57 were provided, the effect (buffer effect) to make the developer stay by reducing the transporting speed at which the developer passes over the regulating portion 52 present between the first disk 55 and the second disk 57 was so strong that, even when the absolute humidity and the fluidity of developer were varied, an effect to keep the height of the developer constant was obtained.

The above results confirm the following. With the developing devices 3*a* according to practical examples, in which the first disk 55 is arranged between the second helical blade 44*a* and the regulating portion 52 and in which the second disk 57 is arranged between the regulating portion 52 and the discharge blade 53, variations in the stable weights of developer can be suppressed against variations in the stirring speed of developer, in the toner concentration in developer, and in the absolute humidity, and it is thus possible to effectively suppress occurrence of image defects and deterioration of developer due to variations in the stirring speed, in the toner concentration, and in the absolute humidity. In particular, it has been confirmed that variations in the stable weights and stable volumes of developer can be notably suppressed against variation in the stirring speed.

It has also been confirmed from the comparison between practical examples 1 and 2 that, by varying the outer diameter of the second disk 57, it is possible to adjust as desired the stable developer amount (stable volume, stable weight) inside the developer container 22.

The present disclosure is applicable to a developing device that supplies two-component developer containing toner and carrier and that discharges surplus developer, and to an image forming apparatus provided with such a developing device. Based on the present disclosure, even when the fluidity and the transport speed of developer vary, it is possible to provide an image forming apparatus that can reduce variations in the height and weight of developer in a developer container.

What is claimed is:

1. A developing device comprising:

a developer container for storing two-component developer containing carrier and toner, the developer container including a plurality of transport chambers, including a first transport chamber and a second transport chamber, arranged side by side, a communication portion through which the first and second transport chambers communicate with each other in opposite end parts thereof in a longitudinal direction thereof, a developer supply port through which developer is supplied into the developer container, and a developer discharge port through which surplus developer is discharged, the developer discharge port being arranged in a downstream-side end part of the second transport chamber;

a first stirring member composed of a rotary shaft and a first transport blade formed on a circumferential surface of the rotary shaft, for stirring and transporting developer inside the first transport chamber in an axial direction of the rotary shaft;

a second stirring member composed of a rotary shaft and a second transport blade formed on a circumferential surface of the rotary shaft, for stirring and transporting developer inside the second transport chamber in an opposite direction to the first stirring member; and a developer carrying member rotatably supported on the developer container, for carrying the developer inside the second transport chamber on a surface of the developer carrying member, wherein the second stirring member comprises:

a regulating portion which is formed next to, on a downstream side of, the second transport blade with respect to a transport direction of the developer inside the second transport chamber, and which is formed by a transport blade that transports developer in an opposite direction to the second transport blade;

a discharge blade which is formed next to, on a downstream side of, the regulating portion with respect to the transport direction of the developer inside the second transport chamber, and which transports developer in a same direction as the second transport blade so as to discharge the developer through the developer discharge port;

a first disk which is a plate-shaped member formed between the second transport blade and the regulating portion and which protrudes in a radial direction around an entire circumference of the rotary shaft; and a second disk which is a plate-shaped member formed between the regulating portion and the discharge blade and which protrudes in a radial direction around an entire circumference of the rotary shaft.

2. The developing device of claim 1, wherein an outer diameter of the second disk is equal to or smaller than an outer diameter of the first disk.

3. The developing device of claim 1, wherein an outer diameter of the first disk is equal to or smaller than an outer diameter of the second transport blade.

4. An image forming apparatus comprising the developing device of claim 1.

* * * * *